US012378046B2

(12) United States Patent
Cooper et al.

(10) Patent No.: US 12,378,046 B2
(45) Date of Patent: Aug. 5, 2025

(54) RESTRICTED ACCESS CONTAINER

(71) Applicant: WVC Holdings, Inc., Denver, CO (US)

(72) Inventors: Jeremy Cooper, Denver, CO (US); Jeremiah Buck, Denver, CO (US); Timothy Hanley, Denver, CO (US); Zachariah Johnson, Denver, CO (US)

(73) Assignee: WVC Holdings, Inc., Denver, CO (US)

( * ) Notice: Subject to any disclaimer, the term of this patent is extended or adjusted under 35 U.S.C. 154(b) by 802 days.

(21) Appl. No.: 17/294,249

(22) PCT Filed: Nov. 14, 2019

(86) PCT No.: PCT/US2019/061463
§ 371 (c)(1),
(2) Date: Oct. 26, 2021

(87) PCT Pub. No.: WO2020/102522
PCT Pub. Date: May 22, 2020

(65) Prior Publication Data
US 2022/0089336 A1 Mar. 24, 2022

Related U.S. Application Data

(60) Provisional application No. 62/767,960, filed on Nov. 15, 2018.

(51) Int. Cl.
*B65D 50/04* (2006.01)
*B65D 6/06* (2006.01)
(Continued)

(52) U.S. Cl.
CPC ..... *B65D 50/045* (2013.01); *B65D 11/12* (2013.01); *B65D 43/0231* (2013.01);
(Continued)

(58) Field of Classification Search
CPC .. B65D 50/045; B65D 11/12; B65D 43/0231; B65D 85/10
See application file for complete search history.

(56) References Cited

U.S. PATENT DOCUMENTS 4,126,224 A * 11/1978 Laauwe ..... B65D 43/20 220/345.2
4,561,544 A 12/1985 Reeve
(Continued)

FOREIGN PATENT DOCUMENTS

DE 10002817 A1 * 8/2001 ..... B65D 43/20

OTHER PUBLICATIONS

International Search Report and Written Opinion dated Mar. 31, 2020 for International Patent Application No. PCT/US2019/061463, 10 pages.
(Continued)

*Primary Examiner* — Anthony D Stashick
*Assistant Examiner* — L Kmet
(74) *Attorney, Agent, or Firm* — Morgan, Lewis & Bockius LLP

(57) ABSTRACT

A restricted access container may include an outer shell and an inner tray. The outer shell may define a recess. The outer shell may include a first wall, a second wall, a third wall, and an opening. The first wall may include a hole and a notch. The second wall may be opposite the first wall. The third wall may be coupled to each of the first wall and the second wall. The opening may be opposite the third wall. The inner tray may define a receiving area. The inner tray may include a tab, a first protrusion, and a second protrusion. The first protrusion may be disposed on the tab. The inner tray may be inserted through the opening into the recess of the outer shell such that the first protrusion is disposed within the hole
(Continued)

of the first wall to fix the inner tray to the outer shell and the second protrusion is disposed within the notch.

23 Claims, 18 Drawing Sheets

(51) Int. Cl.
*B65D 43/02* (2006.01)
*B65D 85/10* (2006.01)

(52) U.S. Cl.
CPC .... *B65D 85/10* (2013.01); *B65D 2543/00092* (2013.01); *B65D 2543/00296* (2013.01); *B65D 2543/00527* (2013.01); *B65D 2543/00537* (2013.01); *B65D 2543/00842* (2013.01)

(56) References Cited

U.S. PATENT DOCUMENTS

| | | | | |
|---|---|---|---|---|
| 7,757,843 | B2 | 7/2010 | Katsis | |
| 8,672,134 | B2 | 3/2014 | Sprada et al. | |
| 2009/0152134 | A1* | 6/2009 | Katsis | B65D 5/38 206/96 |
| 2015/0224026 | A1 | 8/2015 | Davidson et al. | |

OTHER PUBLICATIONS

Canadian Office Action, dated Jan. 9, 2023, for corresponding Canadian Patent Application No. 3,120,285, 4 pages.

* cited by examiner

RESTRICTED ACCESS CONTAINER

CROSS-REFERENCE TO RELATED APPLICATIONS

This application is a U.S. National Phase of International Application No. PCT/US2019/061463 filed on Nov. 14, 2019, which claims the benefit of U.S. Provisional Patent Application No. 62/767,960 filed Nov. 15, 2018 entitled "Child-Proof Container", each of which is incorporated by reference herein in its entirety.

BACKGROUND OF THE INVENTION

The present invention generally relates to a container and, more particularly, to a child proof container.

Containers are used to store a variety of items and personal affects. For example, containers can be used to store items such as tobacco, *cannabis*, or cigarettes. It may be preferable to restrict access to these items for some people such as children. A lock or securing feature can be implemented in these containers to render them restricted access.

Current restricted access containers with locks and securing features tend to be cumbersome to open. Further, these existing restricted access containers prevent a child from accessing the container but do not allow for quick access by an adult. Accordingly, there is a need for a more effective and easily accessible restricted access container for storing items.

BRIEF SUMMARY OF THE INVENTION

In one embodiment, a restricted access container may include an outer shell and an inner tray. The outer shell may define a recess. The outer shell may include a first wall, a second wall, a third wall, and an opening. The first wall may include a hole and a notch. The second wall may be opposite the first wall. The third wall may be coupled to each of the first wall and the second wall. The opening may be opposite the third wall. The inner tray may define a receiving area. The inner tray may include a tab, a first protrusion, and a second protrusion. The first protrusion may be disposed on the tab. The inner tray may be inserted through the opening into the recess of the outer shell such that the first protrusion is disposed within the hole of the first wall to fix the inner tray to the outer shell and the second protrusion is disposed within the notch.

The hole may be defined by a hole sidewall and the first protrusion may engage the hole sidewall such that the inner tray is retained within the outer shell. The tab may flex toward the second wall when a force is applied to the tab. The first protrusion may disengage from the hole sidewall and the inner tray may be removed from the outer shell when the tab flexes toward the second wall. The first protrusion may include a first protrusion outer surface, the second protrusion may include a second protrusion outer surface, and the first wall may include a first wall outer surface. The first protrusion outer surface and the second protrusion outer surface may be flush with the first wall outer surface when the inner tray is within the outer shell.

The notch may be disposed proximate to the opening. The inner tray may include a tray top wall, a tray bottom wall, and a tray side wall. The tab may be disposed on the tray side wall proximate to the bottom wall. A distance from the tray top wall to the tray bottom wall may be less than a distance from the tray top wall to an end of the tab. The tab may be a cantilevered extension of the tray side wall. The first protrusion and the second protrusion may have the same shape. The second wall may include a second notch and a second hole. The inner tray may include a second tab, a third protrusion, and a fourth protrusion. The third protrusion may be disposed on the second tab. The third protrusion may be within the second hole and the fourth protrusion may be within the second notch when the inner tray is within the recess of the outer shell. The first protrusion, second protrusion, third protrusion, and fourth protrusion may have the same shape.

In one embodiment, a restricted access container includes a cover and a base. The cover may include a cover top wall, a cover side wall extending downwardly from the cover top wall, a leg extending outwardly from the cover side wall, and a protrusion extending inwardly from the cover side wall. The base may include a base bottom wall, a base side wall, a flange, a locking mechanism, and a biasing element. The base side wall may extend upwardly from the base bottom wall. The base side wall and base bottom wall may define a receiving area. The flange may extend outwardly from the base side wall. The locking mechanism may be disposed on the base side wall. The locking mechanism may include a recess. The biasing element may be disposed on the flange and moveable between a first position and a second position. The cover may be coupled to the base such that the biasing element moves from the first position to the second position and the protrusion is disposed within the recess of the locking mechanism.

The biasing element may biases the cover away from the flange of the base. The cover may be rotatable relative to the base to move the cover between a locked configuration wherein the protrusion is within the recess and an unlocked configuration wherein the protrusion is out of the recess. The locking element may include an angled portion and the protrusion may engage the angled portion as the cover is rotated relative to the base such that the cover is urged toward the flange of the base. The locking mechanism may include a lip extending from the locking mechanism toward the flange, wherein the lip engages the protrusion to prevent rotation of the cover when the protrusion is within the recess. The flange may include an opening and the biasing element may move at least partially into the opening as the biasing element moves from the first position to the second position. The base may include a plurality of biasing elements and a plurality of locking mechanisms alternatingly positioned about the perimeter of the base side wall.

BRIEF DESCRIPTION OF THE SEVERAL VIEWS OF THE DRAWINGS

The following detailed description of embodiments of the restricted access container, will be better understood when read in conjunction with the appended drawings of an exemplary embodiment. It should be understood, however, that the invention is not limited to the precise arrangements and instrumentalities shown.

DETAILED DESCRIPTION OF THE EXEMPLARY EMBODIMENTS OF THE INVENTION

Figure 1:
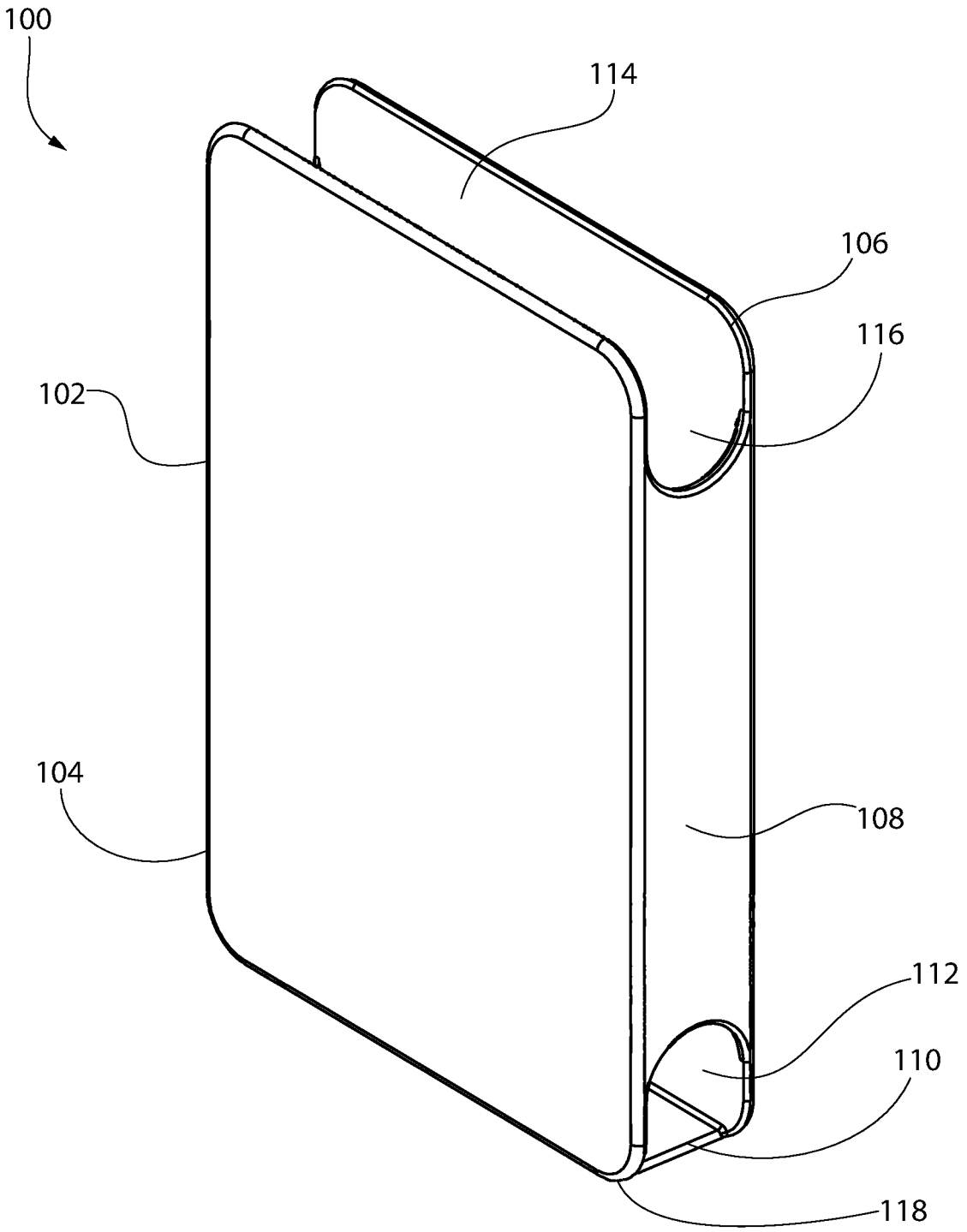
FIG. 1 is a perspective view of a shell of an exemplary restricted access container in accordance with one embodiment of the present invention.

Exemplary embodiments of the present invention provide a restricted access container. The container may be a child-resistant packing. Child resistant packaging may mean packaging that is designed and constructed to be significantly difficult for children under 5 years of age to open or obtain a toxic or harmful amount of the substance contained therein within a reasonable time, and that is not difficult for normal adults to use properly.

Exemplary embodiments of the present invention are shown in FIGS. 1-15B. In use, restricted access container 100 may facilitate the storage and securement of pre-rolled cigarettes, tobacco, or *cannabis*. Restricted access container 100 may also facilitate storage and securement of other items, such as medicines, sharp objects, or objects where it is desirable to prevent persons (e.g., children) from accessing. Some users (e.g., children) may lack the cognitive and/or motor skills necessary to open the restricted access container 100 while other users (e.g., adults) may open and close restricted access container 100 with relative ease.

Referring to FIGS. 1-8C, an embodiment of restricted access container 100 may include outer shell 102 and inner tray 202. Outer shell 102 may include front wall 104, back wall 106, side walls 108, bottom wall 110, holes 112, upper opening 114 and upper notches 116. Outer shell 102 may be configured to receive inner tray 202. For example, inner try 202 may be sized and shaped to be received by outer shell 102. In an embodiment, inner tray 202 is disposed within and secured to outer shell 102 in a manner preventing a child from accessing the contents stored within restricted access container 100. Inner tray 202 may include back surface 204, side walls 206, bottom wall 208, flanges 209, top wall 210, and recess 214. Side walls 206 of inner tray 202 may include upper protrusions 216 and tabs 212, which may include lower protrusions 218.

Referring to FIGS. 1-4, outer shell 102 may be comprised of front wall 104, back wall 106, side walls 108, and bottom wall 110. Front wall 104, back wall 106, side walls 108 and bottom wall 110 may be comprised out of plastic or thermoplastic polymer (e.g., acrylonitrile butadiene styrene (ABS)). However, front wall 104, back wall 106, side walls 108 and bottom wall 110 may be comprised out of other materials. For example, front wall 104, back wall 106, side walls 108 and bottom wall 110 may be comprised out of other polymers, metal, wood, steel, composite, or any combination thereof.

Front wall 104 and back wall 106 may have a length of about 50 millimeters (mm) to about 200 mm, about 75 mm to about 175 mm, about 100 mm to 125 mm. For example, front wall 104 and back wall 106 may have length of about 98 mm. Front wall 104 and back wall 106 may have a width of about 20 mm to about 120 mm, about 40 mm to about 100 mm, or about 60 mm to about 8 mm. For example, front wall 104 and back wall 106 may have a length of about 68.5 mm. The material comprising front wall 104 and back wall 106 may have a thickness of about 0.5 mm, about 1.0 mm, about 1.5 mm, about 2 mm, about 3 mm, about 4 mm, or about 5 mm.

Corners 118 of front wall 104 and back wall 106 may be rounded with a radius of curvature $R_1$ between about 0 mm to about 10 mm, about 2 mm to about 8 mm, and about 4 mm to about 6 mm. For example, corners 118 of front wall 104 and back wall 105 may have a radius of curvature of about 6.35 mm. Although corners 118 are illustrated as having rounded corners, corners 118 of front wall 104 and back wall 106 may be non-rounded, such as at a right angle or a chamfer.

Figure 2:
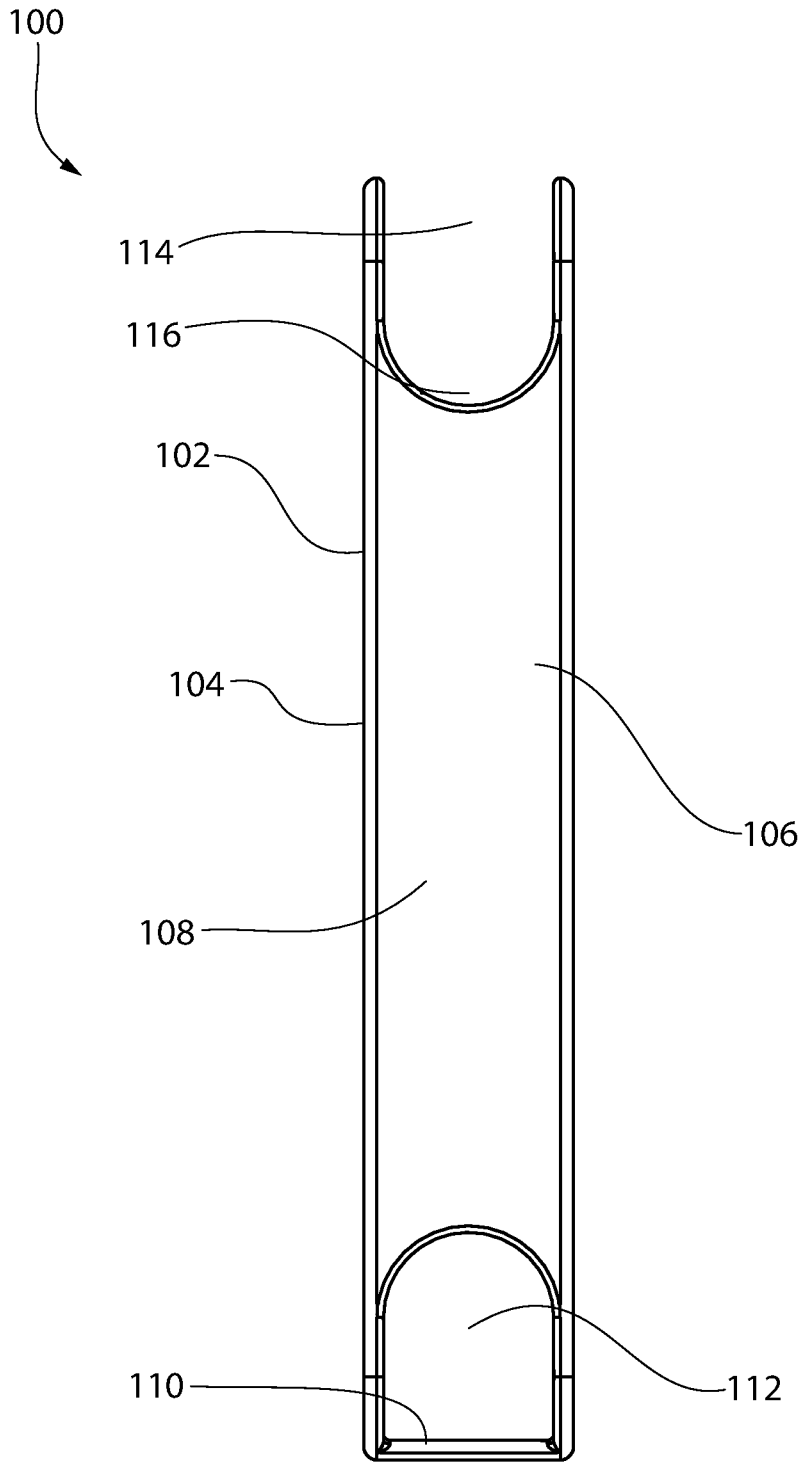
FIG. 2 is a side view of an exemplary restricted access container in accordance with one embodiment of the present invention.
Figure 3:
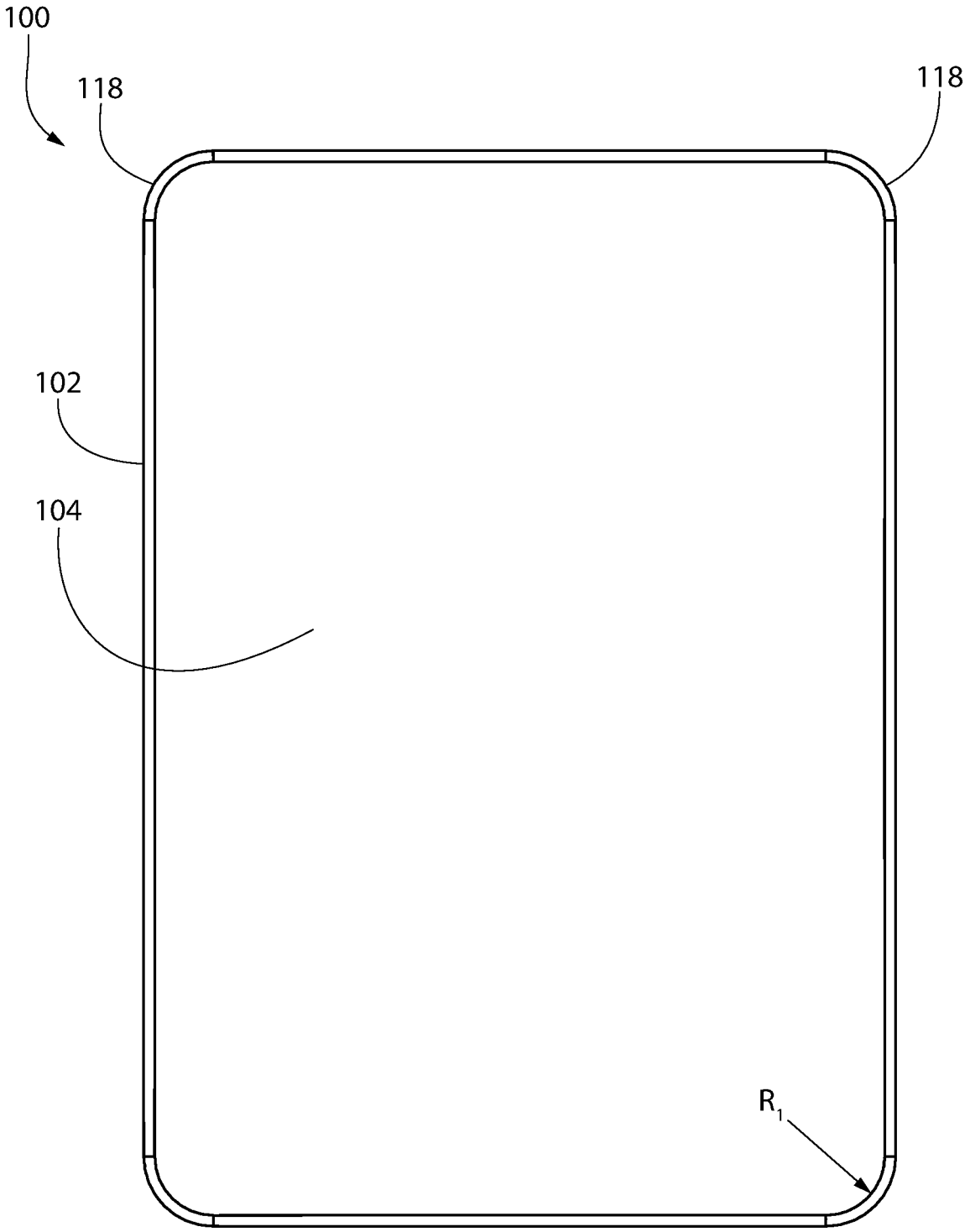
FIG. 3 is a front view of an exemplary restricted access container in accordance with one embodiment of the present invention.
Figure 4:
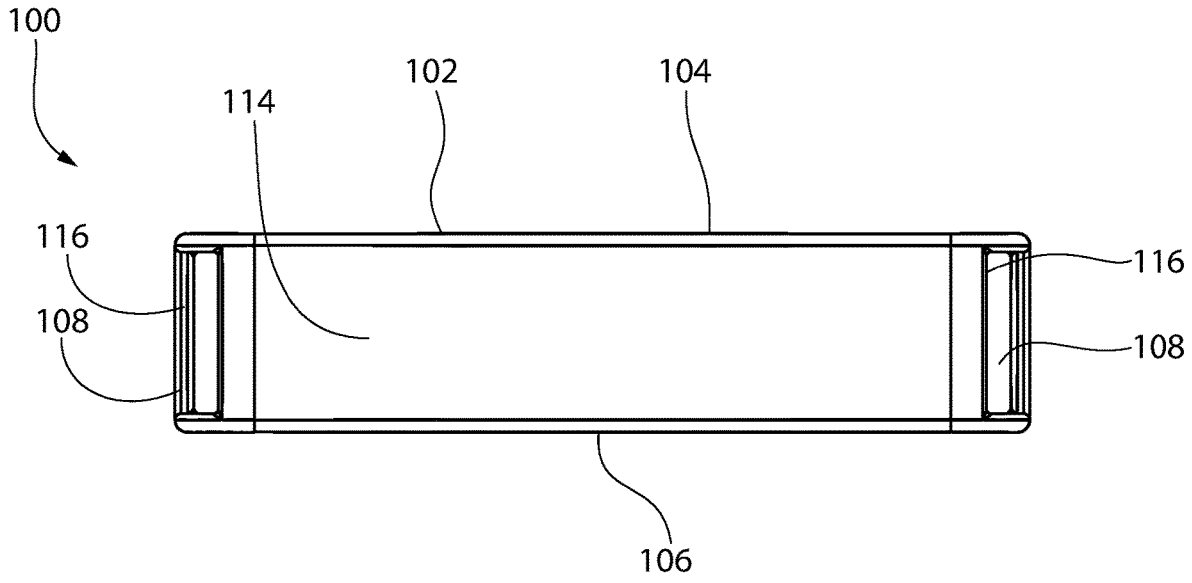
FIG. 4 is a top view of an exemplary restricted access container in accordance with one embodiment of the present invention.

Referring to FIGS. 1 and 2, holes 112 may be disposed between side walls 108 and bottom wall 110. In an embodiment, holes 112 are semi-circular shaped. However, holes 112 may be circular, rectangular, or triangular. Holes 112 may be sized and shaped to receive and secure lower projections 218 of inner tray 202. For example, holes 112 may be configured to receive lower projections 218 when inner tray 202 is inserted into outer shell 102. At least a portion of hole 112 may be defined by an arc segment having a radius of curvature of about 0 mm to about 10 mm, about 2 mm to about 8 mm, and about 4 mm to about 6 mm.

Side walls 108 may further include upper notches 116. Upper notches 116 may be disposed proximate to upper opening 114. Upper notches 116 may be semi-circular having a radius of curvature of between about 0 mm to about 10 mm, about 2 mm to about 8 mm, and about 4 mm to about 6 mm. For example, upper notches 116 may have a radius of curvature of about 6.5 mm. However, upper notches 116 may circular, rectangular, or triangular. Upper notches 116 may be sized and shaped to fit and secure upper protrusions 216. For example, upper notches 116 may be configured to receive upper protrusions 216 when inner tray 202 is inserted into outer shell 102. In some embodiments, upper notches 116 and openings 112 may have a similar or the same shape.

Front wall 104, back wall 106, and side walls 108 may define a recess to receive inner tray 102. Outer shell 102 may further include upper opening 114. Inner tray 202 may be moved into and out of the recess through upper opening 114. In practice, inner tray 202 may be inserted into outer shell 102 to secure contents stored within inner tray 202.

Figure 5:
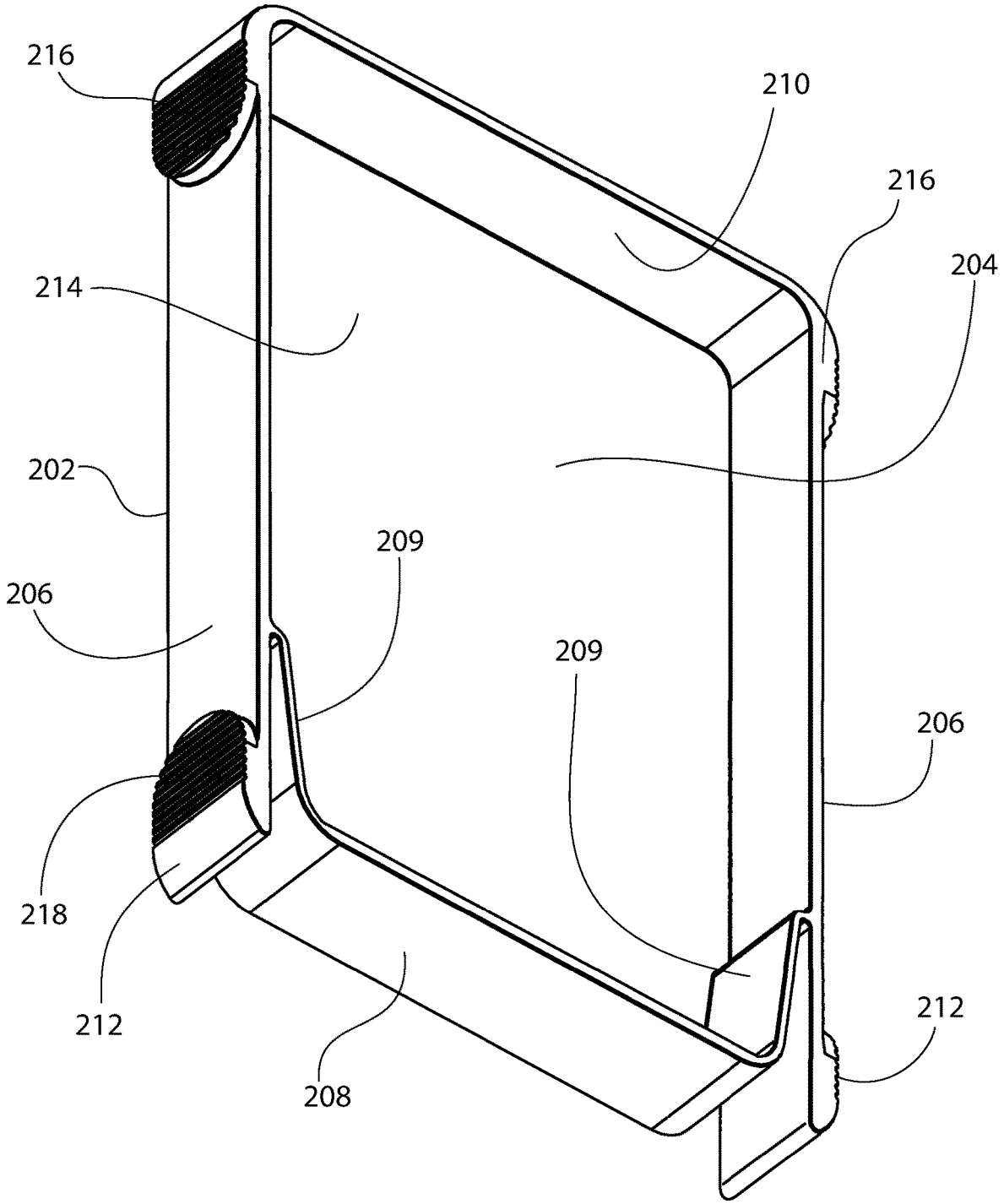
FIG. 5 is a perspective view of a tray of an exemplary restricted access container in accordance with one embodiment of the present invention.
Figure 6:
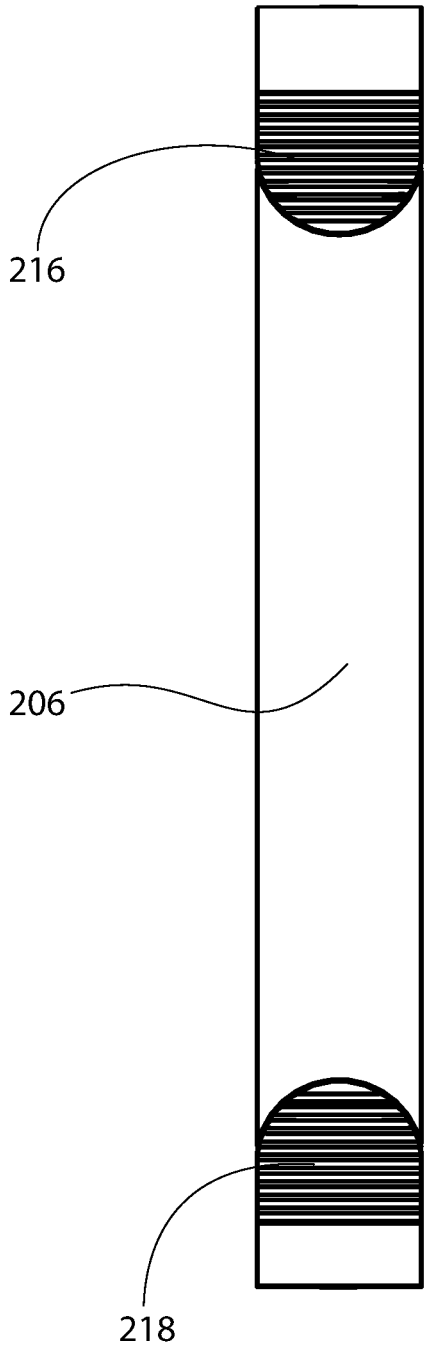
FIG. 6 is a side view of an exemplary restricted access container in accordance with one embodiment of the present invention.
Figure 7:
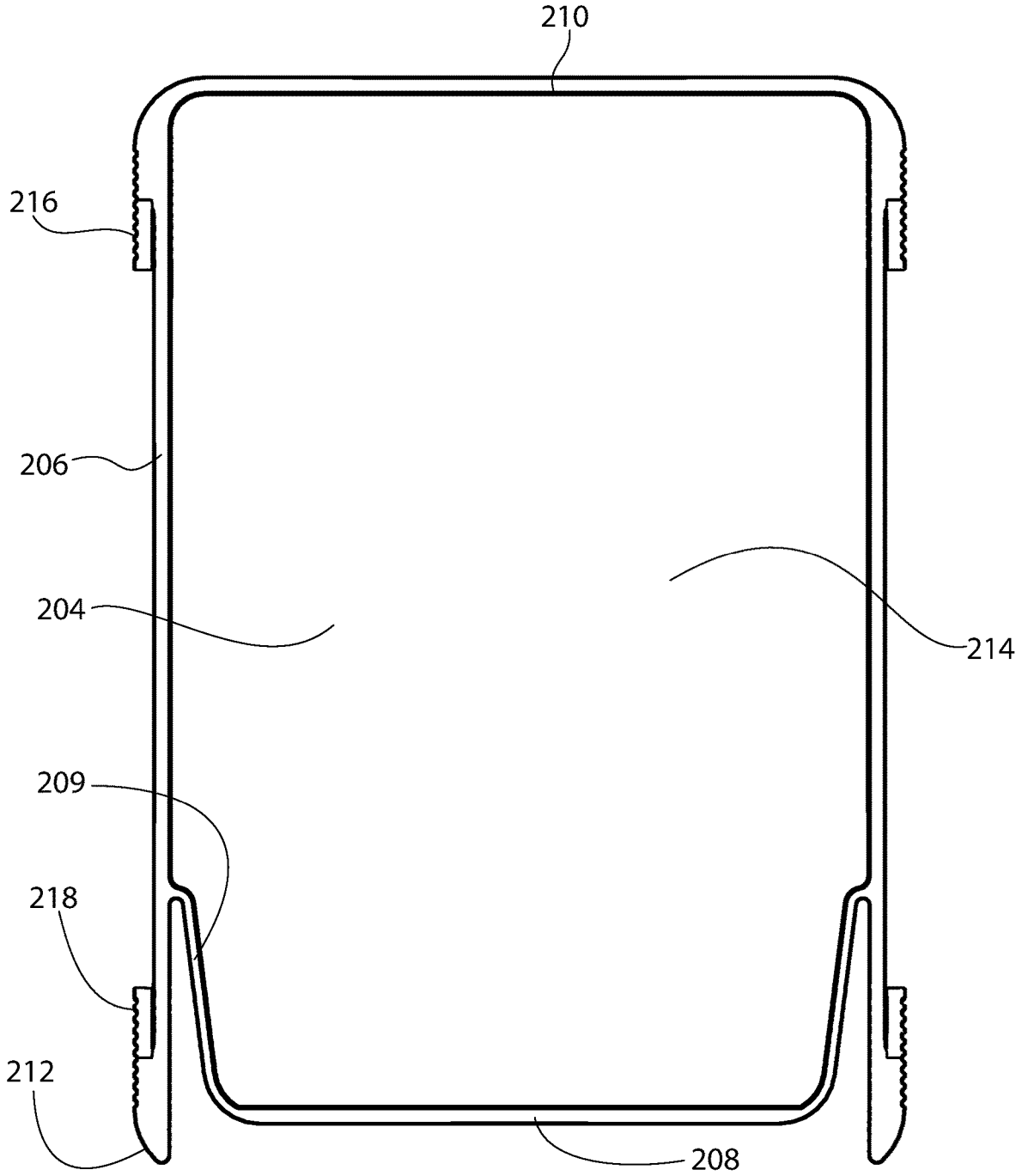
FIG. 7 is a front view of an exemplary restricted access container in accordance with one embodiment of the present invention.
Figure 8A:
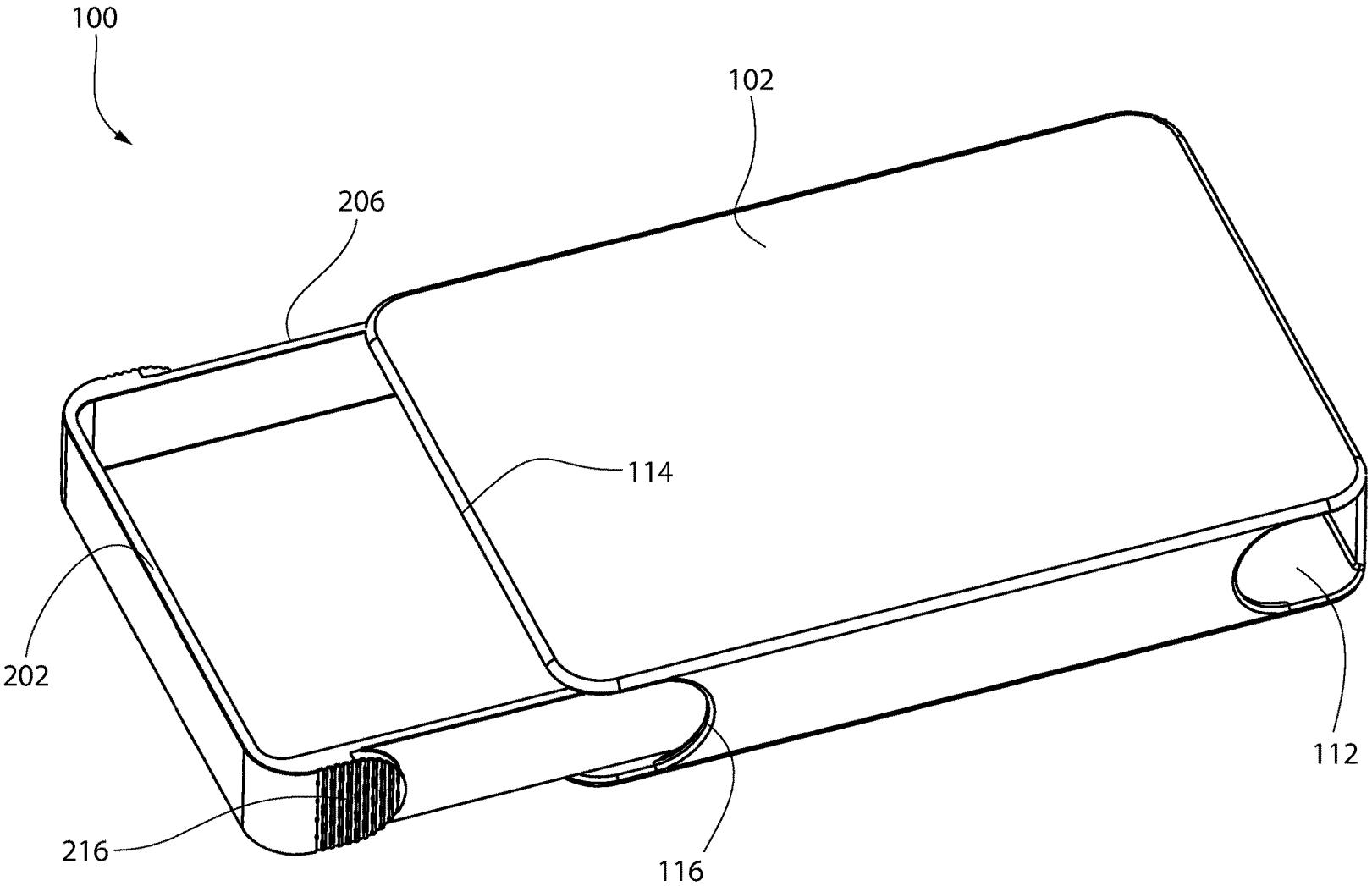
FIG. 8A is a top perspective view of an exemplary restricted access container in accordance with one embodiment of the present invention.
Figure 8B:
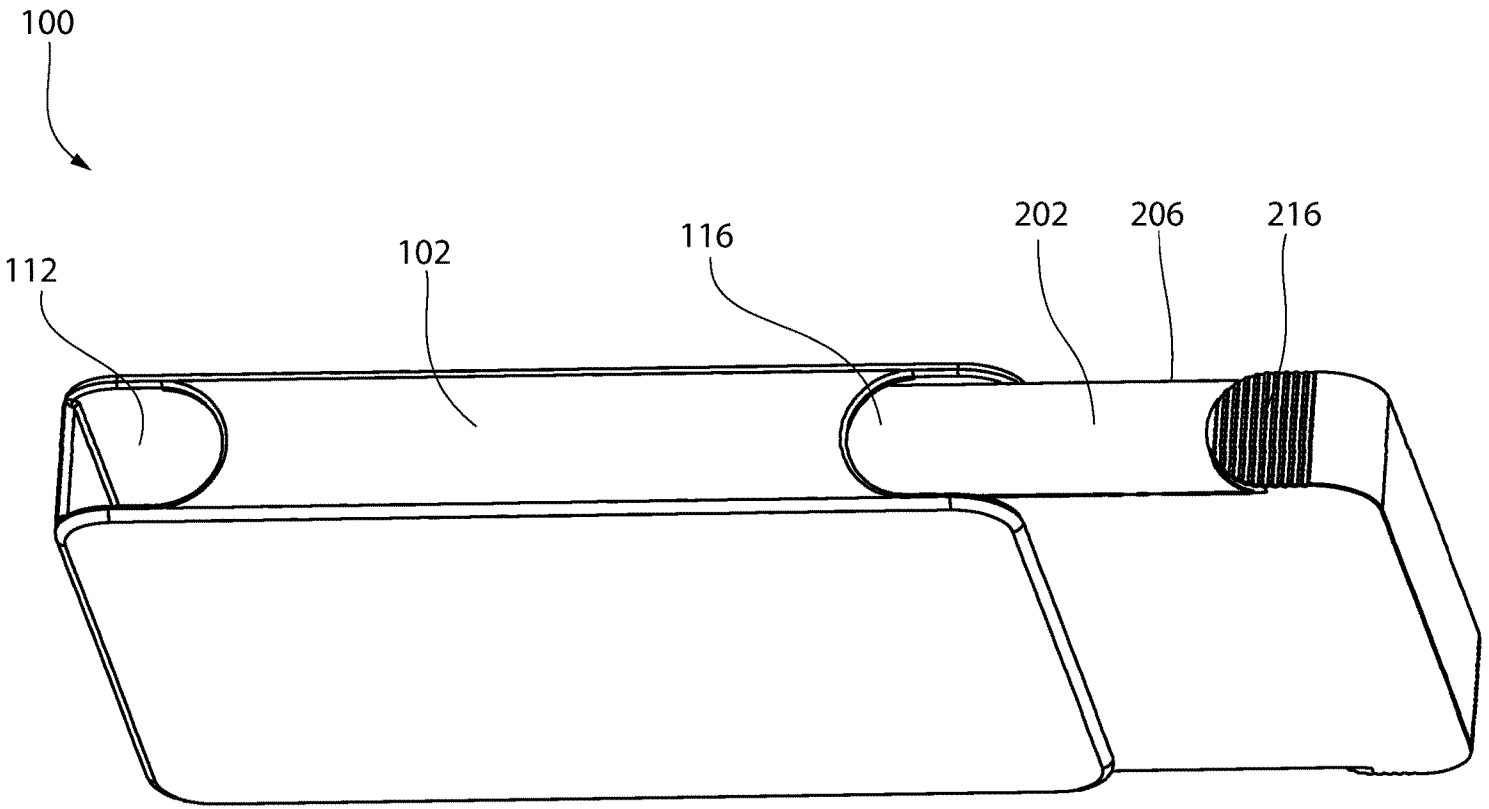
FIG. 8B is a side view of an exemplary restricted access container in accordance with one embodiment of the present invention.
Figure 8C:
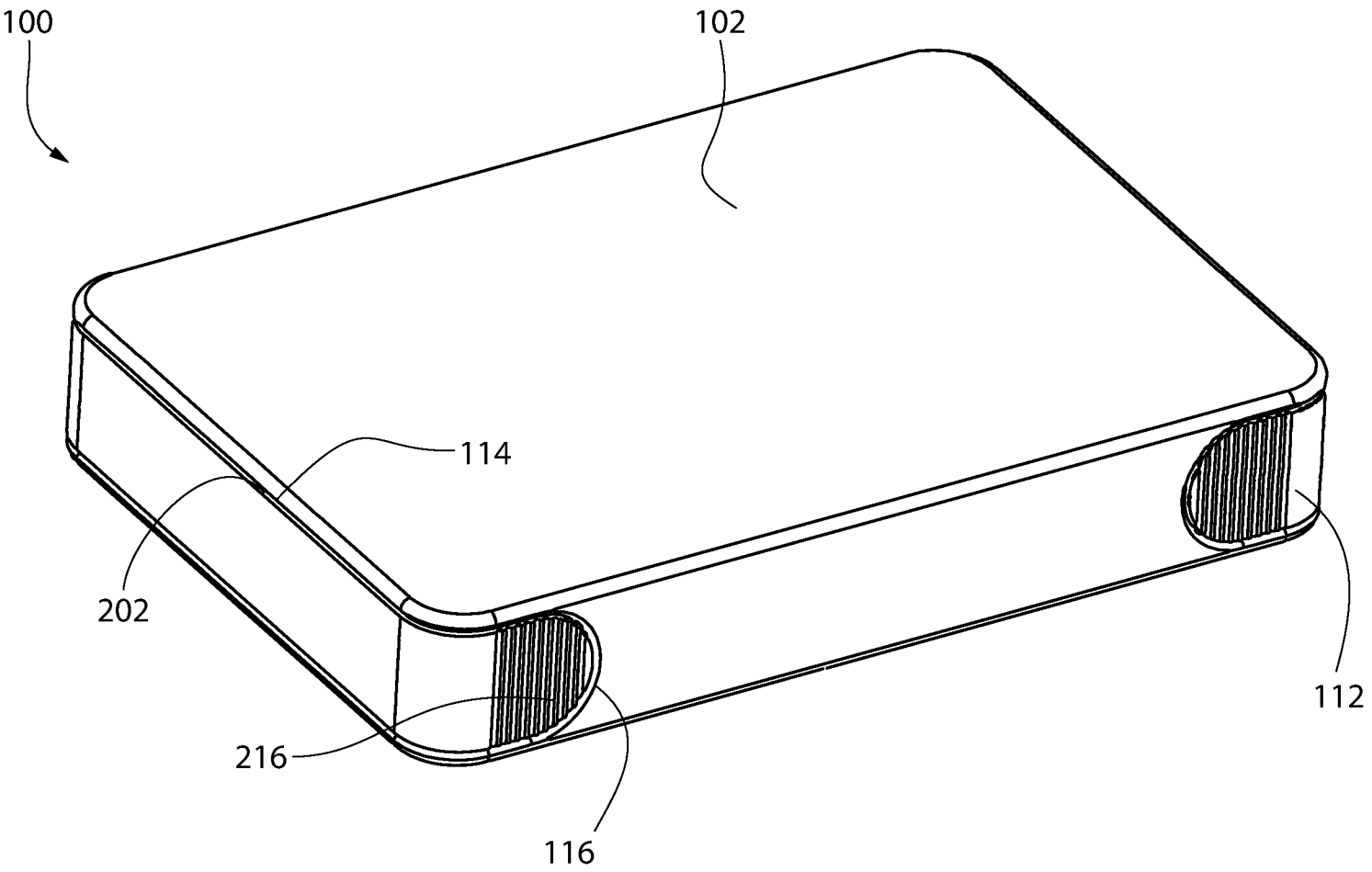
FIG. 8C is a top perspective view of an exemplary restricted access container in accordance with one embodiment of the present invention.

In reference to FIGS. 5-7, inner tray 202 may be comprised of back surface 204, side walls 206, bottom wall 208 and top wall 210. In an embodiment, back surface 204, side walls 206, bottom wall 208 and top wall 210 form recess 214. Back surface 204, side walls 206, bottom wall 208 and top wall 210 of inner tray 202 may be comprised of plastic or thermoplastic polymer (e.g., acrylonitrile butadiene styrene (ABS)). However, back surface 204, side walls 206, bottom wall 208 and top wall 210 may be comprised of other materials, such as other polymers, metal, wood, steel, composite, or any combination thereof.

Inner tray 202 may be sized and shaped to be received by outer shell 102 and nested within outer shell 102. Inner tray 202 may have a width of about 20 mm to about 120 mm, about 40 mm to about 100 mm, or about 60 mm to 80 mm. For example, inner tray 202 may have a width of about 68.5 mm. Inner tray 202 may have a length of about 80 mm to 140 mm, about 90 mm to 130 mm, or about 100 mm to about 120 mm. For example, inner tray 202 may have a length of about 96.47 mm. Further, side walls 206 may have a height of about 0 mm to about 25 mm, about 5 mm to about 20 mm, or about 10 mm to about 15 mm. For example, side walls 206 may have a height of about 12.5 mm. Side walls 206 may have a length of about 80 mm to about 140 mm, about 90 mm to about 130 mm, about 100 mm to about 120 mm. For example, side walls 206 may have a length of about 96.47 mm. Back surface 204 may have a length of about 80 mm to about 140 mm, about 90 mm to about 130 mm, or about 100 mm to about 120 mm, and a width of about 50 mm to about 100 mm, about 60 mm to about 90 mm, or about 70 mm to about 80 mm. For example, bottom surface 205 may have a length of about 93 mm and a width of about 62 mm.

Back surface 204 may include top corners 215. Top corners 215 of back surface 204 may be rounded and may have a radius of curvature between about 0 mm to about 10 mm, about 2 mm to about 8 mm, or about 4 mm to about 6 mm. For example, top corner 215 may have a radius of curvature of about 6.35 mm. In an embodiment of the present invention, as shown in FIGS. 5 and 7, bottom wall 208 of inner tray 202 include flanges 209. Flanges 209 may be comprised of the same material as bottom wall 208 and may extend from the ends of bottom wall 208 to engage with side walls 206. In an embodiment, flanges 209 extend from the lateral ends of bottom wall 208 to engage with side wall 206. Flanges 209 may curve from bottom wall 208 to side wall 206 to engage with side walls 206.

In an embodiment, side walls 206 include upper protrusions 216 disposed proximate to top wall 210 of inner tray 202. Upper protrusions 216 may be sized and shaped to fit within holes 212. Upper protrusions 216 may be semi-circular in shape and be disposed on the top of side walls 206 adjacent to top wall 210. In an embodiment of the present invention, upper protrusions 216 include ridges 217. For example, upper protrusions 216 may include multiple ridges 217 to allow a user to securely grip upper protrusions 216 of inner tray 202. Upper protrusions 216 may be rigid such that the protrusions do not flex when an inward force (e.g., a force applied on one upper protrusion 216 toward another upper protrusion 216) is applied to upper protrusion 216.

Side walls 206 may further include tabs 212, which may be disposed proximate to bottom wall 208. Tabs 212 may extend from side walls 206 towards bottom wall 208. Tabs 212 may be a cantilevered extension of side walls 206.

Tabs 212 may be comprised of the same material as side walls 206 or a different material. Tabs 212 may be comprised of a semi-rigid material to allow for bending and flexing of tabs 212. The material may be selected such that a child does not have enough grip strength to manually flex tabs 212. As shown in FIGS. 5 and 7, tabs 212 may extend towards bottom wall 208 further than where flange 209 engages with side wall 206. Tabs 212 may be offset from flanges 209 at a selected angle. For example, tabs 212 may be offset from flanges 209 at an angle of about 0° to about 18°, about 4° to about 14°, or about 8° to about 10°. For example, tabs 212 may be offset from flanges 209 at an angle of about 7.13°. In an embodiment, tabs 212 are configured to be moved inwards towards flanges 209. For example, a user may apply pressure to tabs 212 (e.g., manually) to move tabs 212 inwards toward flanges 209. Tabs 212 may be biased to be straight and/or parallel to side walls 206 when no pressure is applied to tabs 212. In an embodiment of the present invention, tabs 212 include lower protrusions 218, which may be semi-circular in shape and may include ridges 219. Lower protrusions 218 may be sized and shaped to be disposed and secured within holes 112 of outer shell 102. The distance from the top wall 210 to the end of the tab 212 may be greater than the distance between the top wall 210 and the bottom wall 208. The end of the tab 212 may be the lowermost portion of the container when the bottom wall 208 is placed on a horizontal surface and the top wall 210 is positioned above the bottom wall 208.

Referring to FIGS. 1-8C, outer shell 102 may be configured to receive inner tray 202. For example, inner tray 202 may be inserted and disposed within outer shell 102. Inner tray 202 and outer shell 102 may be configured to couple together in a manner that prevents a child from removing inner tray 202 from outer shell 102. For example, when inner tray 202 is inserted within outer shell 102, lower protrusion 218 of tabs 212 engage with holes 212 such that lower protrusions 218 are secured within holes 212 to lock and secure inner tray 202 within outer shell 102. Upper protrusions 216 may be secured and disposed within upper notches 116. For example, inner tray 202 may be placed within outer shell 102 such that lower protrusions 218 of tabs 212 of inner tray 202 are disposed within holes 112 of outer shell 102, and upper protrusions 216 are received by upper notches 116, thereby ensuring that inner tray 202 is secured within outer shell 102.

Lower protrusions 218 may have the same general appearance as upper protrusions 216. Upper protrusions 216 and lower protrusions 218 may have the same general appearance when the inner tray 202 is within outer shell 102 (e.g., when viewed from the front or the side). Lower protrusions 218 may have the same shape as upper protrusions 216. Lower protrusions 218 may have the same texture as upper protrusions 216. Lower protrusions 218 and upper protrusions 216 having the same general appearance or texture may help prevent unauthorized persons (e.g., a child) from visually determining how to open the container. The tabs 212 may extend below the bottom wall 208 such that the end of the tabs 212 are coplanar with the bottom wall of the outer shell 102 when the inner tray 202 is positioned within the outer shell 102.

In practice, during insertion of inner tray 202 within outer shell 102, tabs 212 may flex and bend towards flanges 209 when inner tray 202 is inserted into outer shell 102 as tabs 212 may be pushed inwards by side walls 108 of outer shell 102. When inner tray 202 is fully inserted within outer shell 102, tabs 212 are no longer restricted and pushed inwards by side walls 108 of outer shell 102, and lower protrusions 218 of tabs 212 are at least partially disposed within holes 112 thereby securing inner tray 202 within outer shell 102. To remove inner tray 202 from outer shell 202, pressure must be applied to lower protrusions 218 of tabs 212 causing tabs 212 to flex or bend inward toward flange 209 of inner tray 202. When tabs 212 are bent or flexed towards flange 209, lower protrusions 218 are no longer disposed within holes 112 allowing inner tray 202 to be easily pulled out of outer shell 102. As a result, a child may not be able to remove inner tray 202 from outer shell 102, as a child may not be able to exert enough force on lower protrusions 218 to bend and flex tabs 212 inward enough towards flange 209 to allow lower protrusion 218 to be completely removed from holes 112 for removal of inner tray 202 from outer shell 102. This prevents a child from accessing the contents disposed within recess 214 of inner tray 202. A child may also lack the cognitive skills to determine how to open the package even if they have the requisite grip strength.

According to an embodiment of the present invention, inner tray 202 may be configured to receive an insert (not shown). The insert may be configured to hold and secure rolled cigarettes (e.g., tobacco or *cannabis* cigarettes). The insert may include rows or columns for holding and securing multiple *cannabis* filled items or cigarettes. For example, the insert may include several rows for securing multiple rolled cigarettes. The insert may be placed within recess 214 of inner tray 202. In an embodiment, the insert is removably coupled to back surface 204 within recess 214. For example, the insert may be removably coupled to bottoms surface 204 via a magnet, hook and loop fasteners, Velcro, adhesives, etc. However, the insert may be coupled to any part of inner tray 202. For example, the insert may be removably coupled to side walls 206, bottom wall 208, or top wall 210. In another embodiment of the present invention, the insert may be fixedly coupled to inner tray 202. For example, the insert may be fixedly coupled to back surface 204 of inner tray 202. The insert may be adjustable within the recess 214 to accommodate different sizes of rolled cigarette.

Referring to FIGS. 9-15B, an embodiment of restricted access container 300 may include cover 302 and base or inner receptacle 402. Cover 302 may include outer circumference 304, side wall 306, inner surface 308, protrusions 310, recess 314, and legs 312. Cover 302 may be configured to couple to inner receptacle 402. In an embodiment, cover 302 is coupled and secured to inner receptacle 402 in a manner that prevents some persons (e.g., a child) from accessing the contents stored within restricted access container 300. Inner receptacle 402 may include side wall 404, inner surface 406, biasing elements 408, flange 410, locking mechanism 412, and recess 418 FIG. 12.

Figure 9:
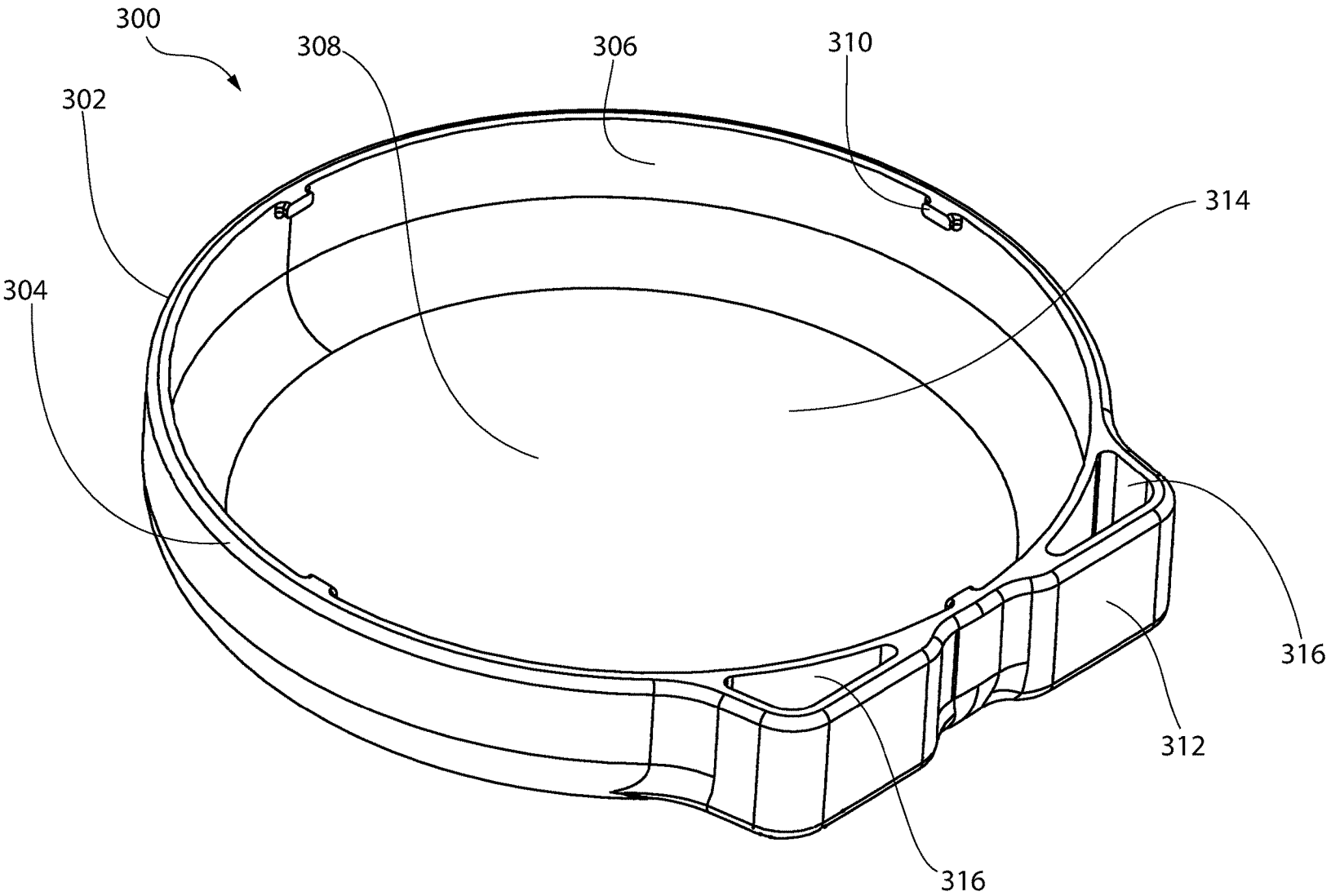
FIG. 9 is a perspective view of an exemplary restricted access container in accordance with one embodiment of the present invention.
Figure 10:
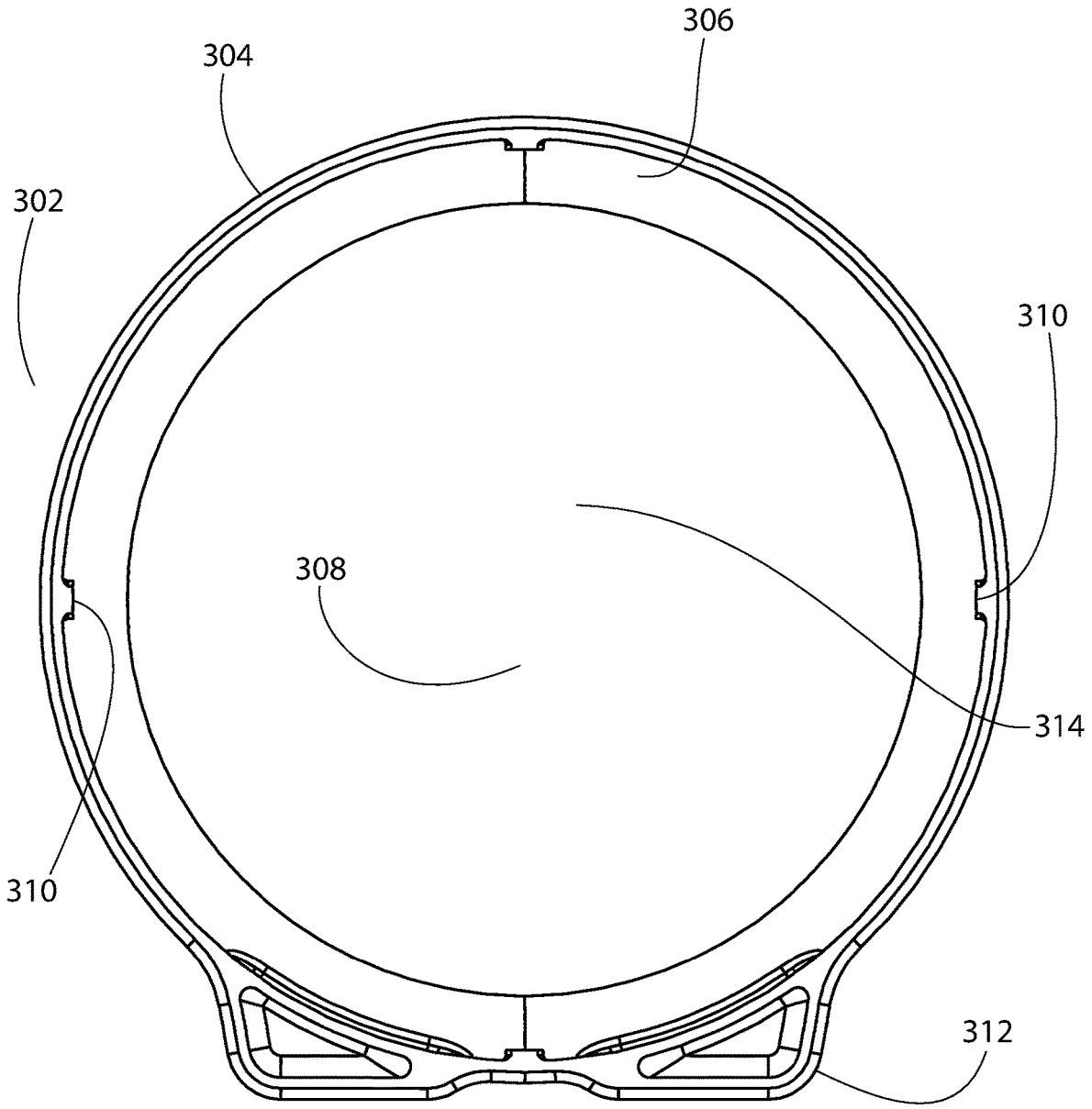
FIG. 10 is a top view of an exemplary restricted access container in accordance with one embodiment of the present invention.
Figure 11:
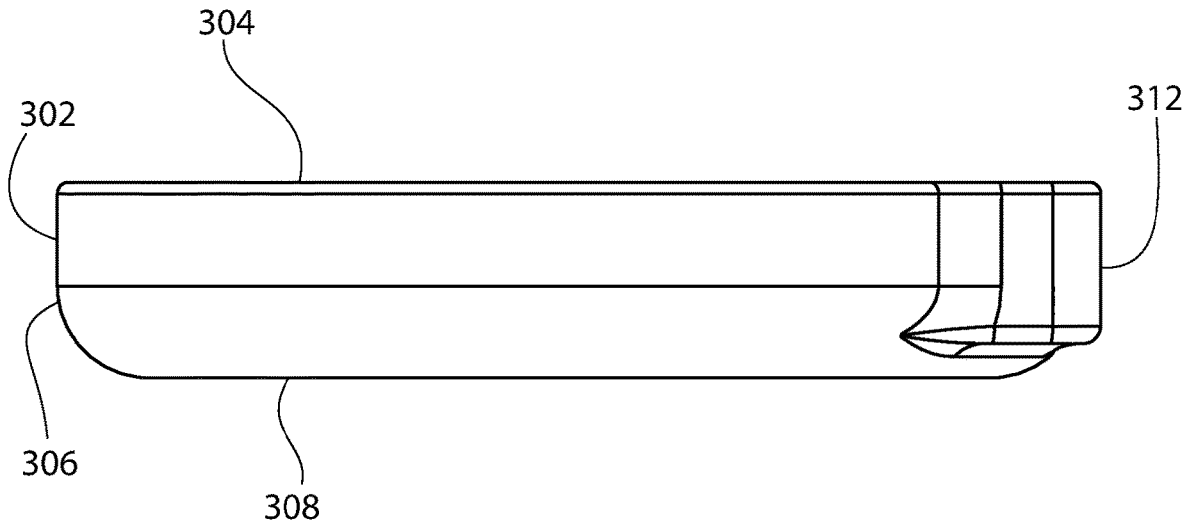
FIG. 11 is a side view of an exemplary restricted access container in accordance with one embodiment of the present invention.

Referring to FIGS. 9-11, cover 302 may include side wall 306 which may extend along outer circumference 304 of cover 302. Cover 302 may be circular in shape and may have a radius between about 10 mm to about 80 mm, about 20 mm to about 60 mm, about 30 mm to 50 mm. For example, cover 302 may have a radius of about 42.5 mm. Cover 302 may also have an outer circumference 304, which may be between about 10 mm to about 120 mm, about 30 mm to about 90 mm, or about 50 mm to about 70 mm. For example, outer circumference 304 may be about 89 mm. Side wall 306 may have a height between about 5 mm to about 35 mm, about 10 mm to about 30 mm, or about 15 mm to about 20 mm. For example, side wall 306 may have a height of about 17 mm. In an embodiment of the present invention, side wall 306 and inner surface 308 form recess 314. Side wall 306 and inner surface 308 may be comprised of plastic or thermoplastic polymer (e.g., acrylonitrile butadiene styrene (ABS)). However, side wall 306 and inner surface 308 may be comprised of any material desired, such as other polymers, metal, wood, steel, composite, or any combination thereof.

Cover 302 may include protrusions 310 which may be disposed on side wall 306, along outer circumference 304. Cover 302 may include protrusions 310 that engage a feature (e.g., a recess or protrusion) on the inner receptacle 402 to couple the cover 302 to the inner receptacle 402.

Protrusions 310 may extend radially toward the interior of cover 302. In an embodiment, cover 302 includes legs 312. Legs 312 may allow cover 302 to stand upright when placed on a flat surface. For example, legs 312 may include proximal end 311 coupled to cover 302 and distal end 313, which has a flat portion allowing cover 302 to be placed upright on flat surfaces. Legs 312 may be disposed on outer circumference 304. In an embodiment, legs 312 are integrally formed with side wall 306. In another embodiment, legs 312 may be removably coupled to side wall 306 of cover 302. Legs 312 may include opening 316 extending therethrough. Opening 316 may be configured to receive a string, rope, chain, or other device capable of allowing restricted access container 300 to be carried. A user may engage (e.g., manually engage) legs 312 to apply a torque to the cover 302 to rotate the cover 302 relative to the inner receptacle 402 or resist rotation of the cover 302 while the inner receptacle 402 is rotated relative to the cover 302.

Figure 12:
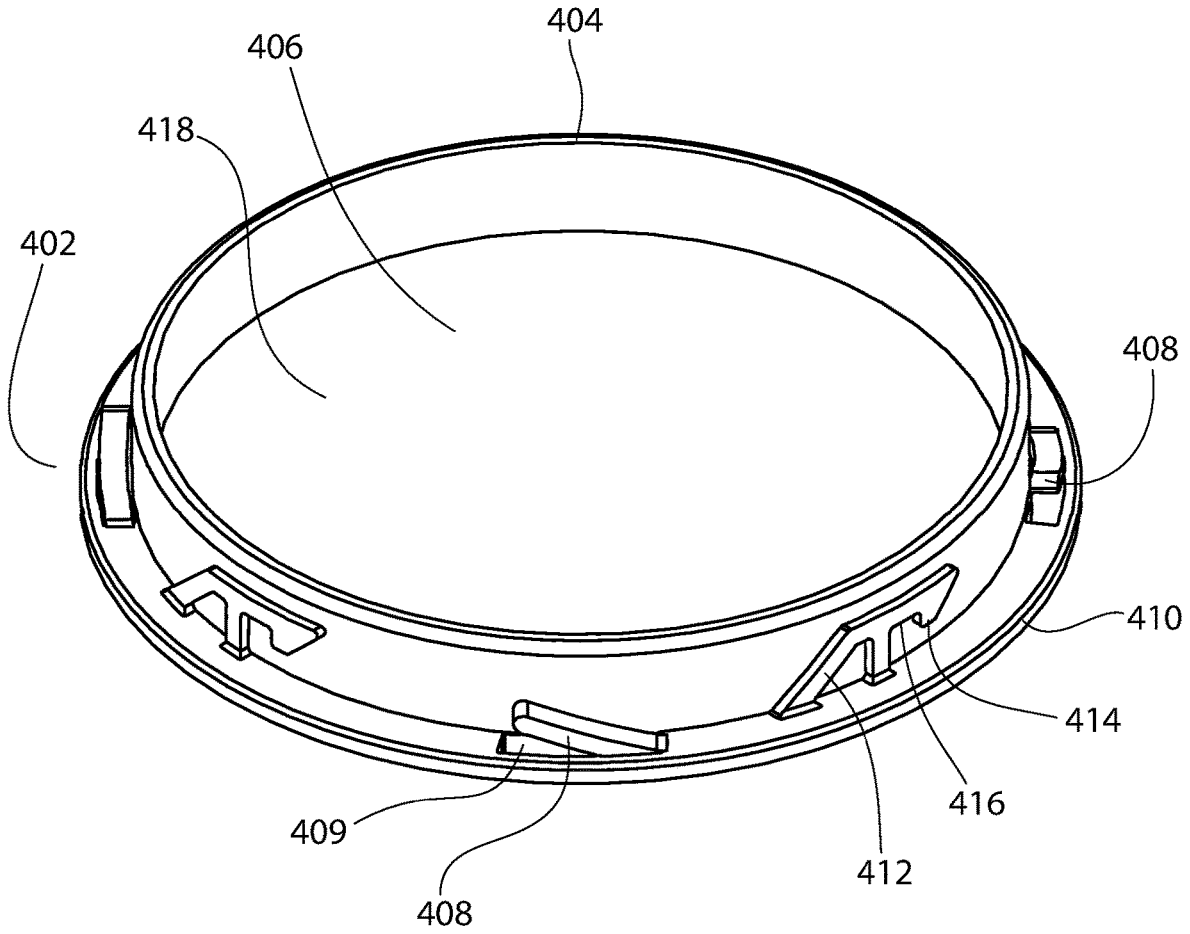
FIG. 12 is a perspective view of an exemplary restricted access container in accordance with one embodiment of the present invention.
Figure 13:
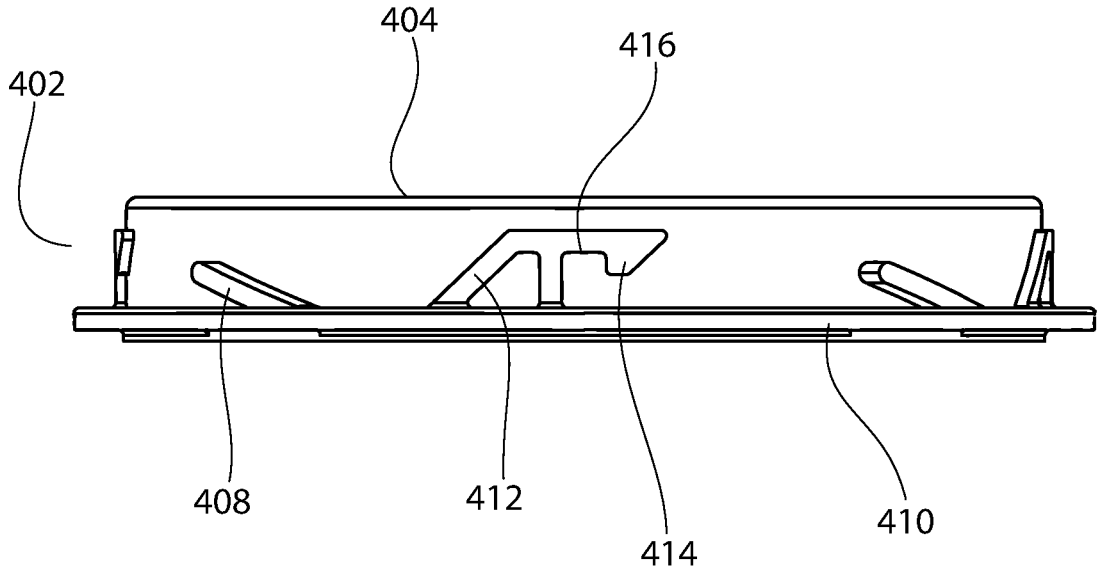
FIG. 13 is a side view of an exemplary restricted access container in accordance with one embodiment of the present invention.
Figure 14:
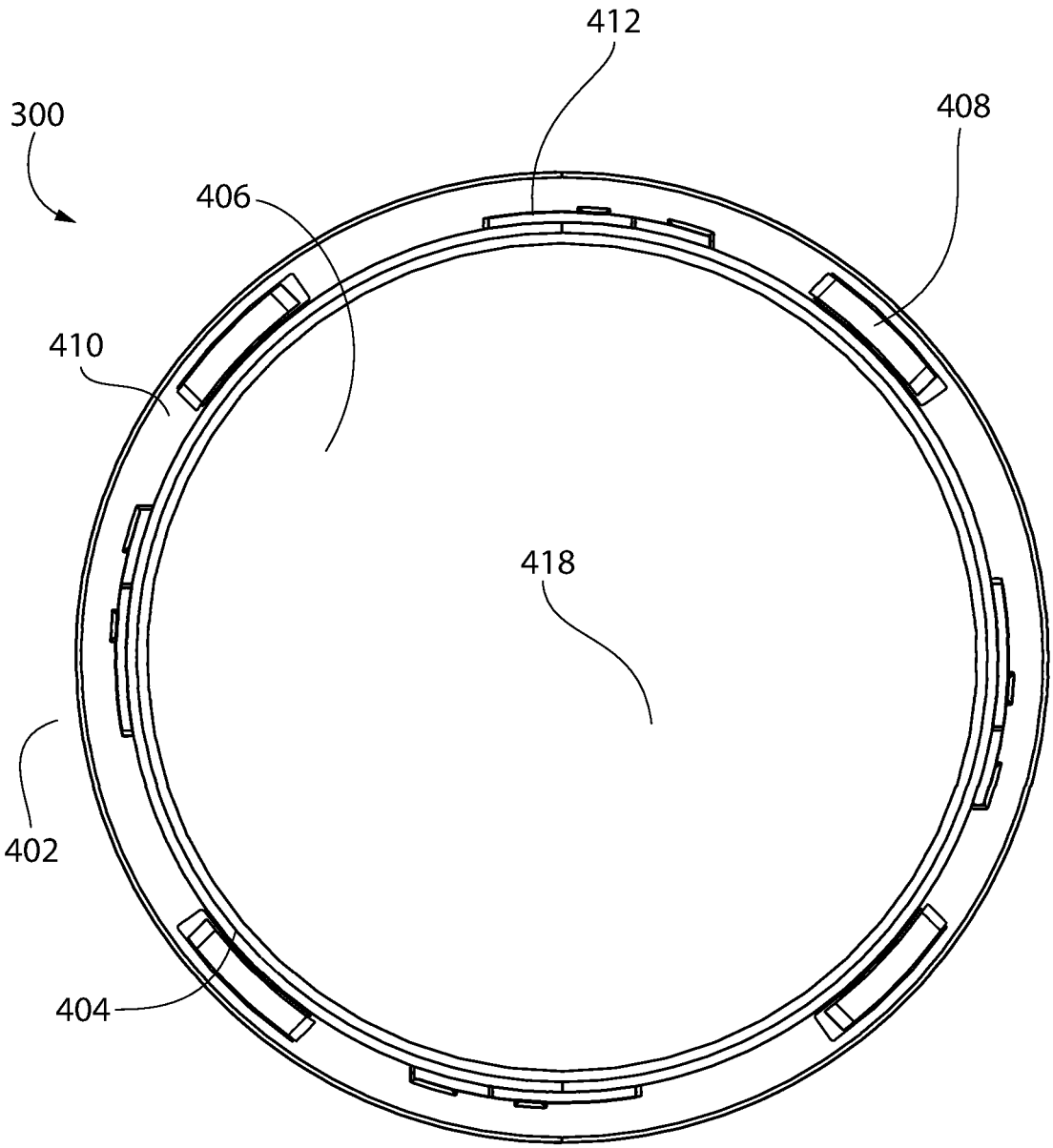
FIG. 14 is a top view of an exemplary restricted access container in accordance with one embodiment of the present invention.
Figure 15A:
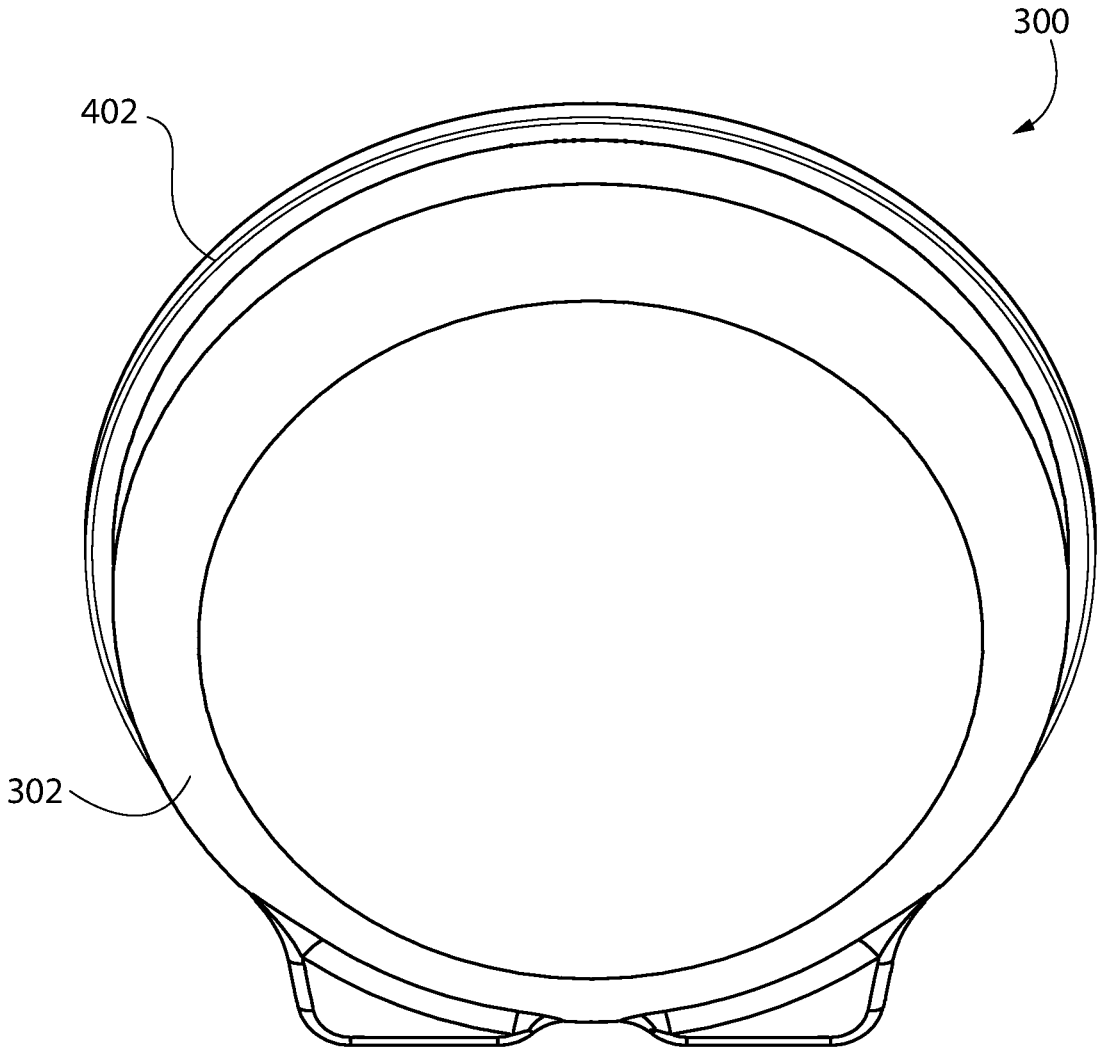
FIG. 15A is a top perspective view of an exemplary restricted access container in accordance with one embodiment of the present invention.
Figure 15B:
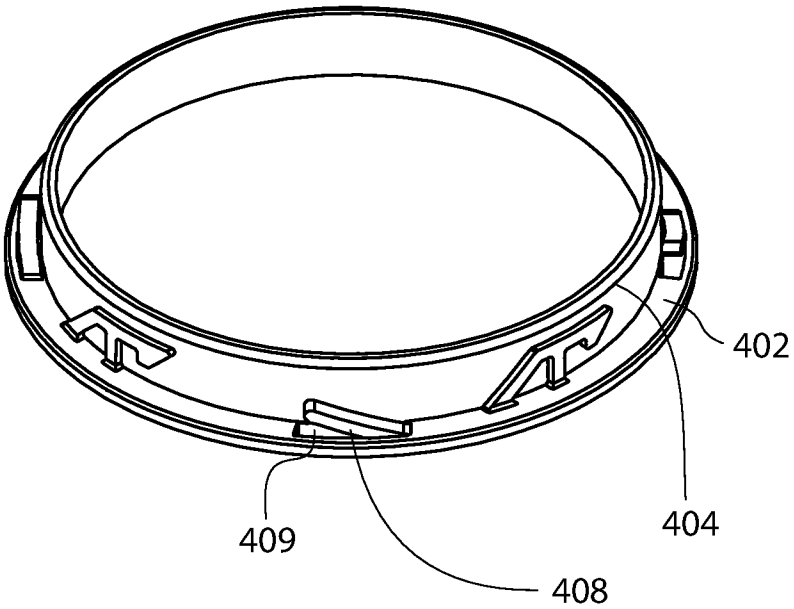
FIG. 15B is a top perspective view of an exemplary restricted access container in accordance with one embodiment of the present invention.
Figure 15B:
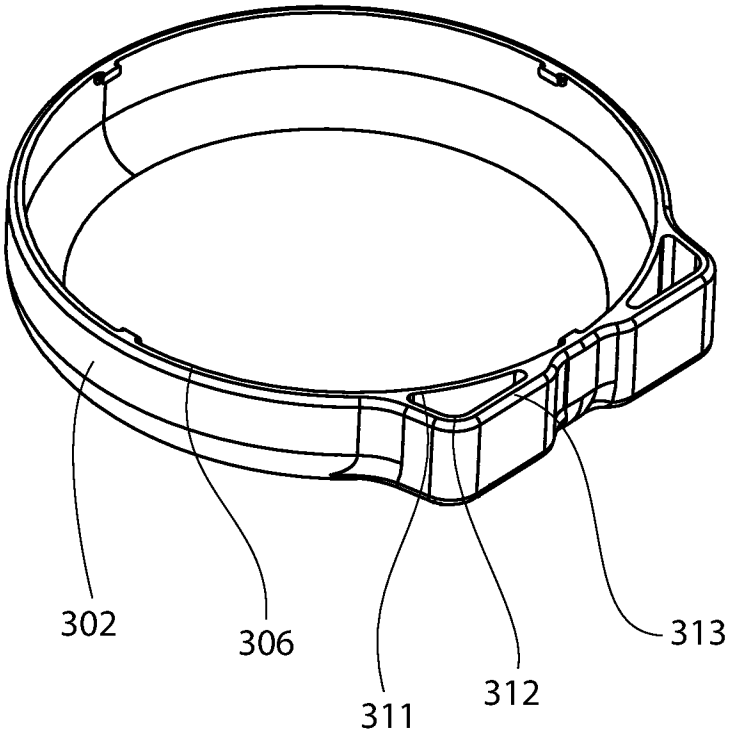

Referring to FIGS. 12-14, inner receptacle 402 may include side wall 404 and inner surface 406. Side wall 404 and inner surface 406 may form recess 418 of inner receptacle 402. Side wall 404 may have a height between about 0 mm to about 30 mm, about 5 mm to about 25 mm, or about 10 mm to about 20 mm. For example, side wall 404 may have a height of about 10 mm. Inner surface 406 may be circular with a radius between about 10 mm to about 80 mm, about 20 mm to about 70 mm, about 30 mm to about 60 mm, or about 40 mm to about 50 mm. For example, inner surface may have a radius of about 39.25 mm.

Side wall 404 may extend along the circumference of inner receptacle 402. Inner receptacle 402 may further include flange 410 which may be disposed along the outer circumference of inner receptacle 402 and may extend outward from side wall 404. Side wall 404 may include locking mechanism 412 and flange 410 may include biasing element 408. Locking mechanism 412 may include retainer 414 and recess 416 and may be disposed on the exterior side of side wall 404. Recess 416 of locking mechanism 412 may be configured to receive and engage with protrusions 310 of cover 302 to secure cover 302 to inner receptacle 402, preventing a child from accessing the contents stored within inner receptacle 402.

Biasing element 408 of flange 410 may keep cover 302 slightly raised relative to inner receptacle 402 preventing cover 302 from engaging and disengaging with inner receptacle 402. For example, biasing element 408 may be biased to keep cover 302 slightly raised such that protrusion 310 is unable move into and out of recess 416 of locking mechanism 412.

Biasing element 408 may be flexible. Biasing element 408 may flex from a first or relaxed position toward the flange 410 to a second or flexed position as the cover 302 is coupled to the inner receptacle 402. Biasing element 408 may move from the second position away from the flange 410 and toward the first position once the protrusion 310 is within recess 416. Protrusion 310 may engage an upper wall of the recess 416 such that the biasing element is in a third position between the first position and the second position when the protrusion 310 is within recess 416 and the cover 302 is coupled to the inner receptacle 402. An opening 409 may extend through the flange 410. The opening 409 may be sized and shaped to receive the biasing element as the biasing element 408 flexes from the first position to the second position. The inner receptacle 402 may include a plurality of biasing elements 408 and a plurality of locking mechanisms 412. The biasing elements 408 and locking mechanisms 412 may be alternatingly positioned about the perimeter of the inner receptacle 402.

Referring to FIGS. 9-15B, cover 302 may be placed on top of inner receptacle 402 such that side wall 306 of cover 302 is disposed around side wall 404 of inner receptacle 402. Cover 302 may then be pushed down, via pressure applied to cover 302, and rotated relative to inner receptacle 402 (e.g., by engaging legs 312) to lock and secure cover 302 to inner receptacle 402. Cover 302 may need to be pushed down relative to inner receptacle 402 to overcome the biasing force of biasing element 408 pushing against side wall 306, causing cover 302 to be slightly raised relative to inner receptacle 402. Side wall 306 of cover 302 being disposed around side wall 404 of inner receptacle 402 and cover 302 being pushed down and rotated relative to inner receptacle 402 allow protrusions 310 to engage with locking mechanism 412. For example, when cover 302 is placed on top of inner receptacle 402, and rotated relative to inner receptacle 402, protrusions 310 may engage retainer 414 of locking mechanism 412.

In some embodiments, the engagement of the angled surface of protrusions 310 on retainer 414 automatically forces cover 302 downward as cover 302 is rotated relative to the inner receptacle 402. In other embodiments, cover 302 is manually pushed down, overcoming the biasing force of biasing element 408, and rotated relative to inner receptacle 402, such that protrusion 310 of inner receptacle 402 goes down and around retainer 414 of locking mechanism 412 and becomes disposed within recess 416 of locking mechanism 412. Once protrusion 310 is within recess 416 of locking mechanism 412, cover 302 may not be able to be further rotated relative to inner receptacle 402. Cover 302 may then no longer need to be pushed down. When protrusion 310 is within recess 416 of locking mechanism 412 and cover 302 is no longer being pushed down relative to inner receptacle 402, then cover 302 can no longer be rotated. Cover 302 may not be rotatable once protrusion 310 is secured with recess 416 of locking mechanism and the biasing force of biasing element 408 causes cover 302 to be slightly raised, further securing protrusion 310 within recess 416.

In practice, some persons (e.g., children) cannot access the contents of restricted access container 300 unless they have the cognitive ability to determine that cover 302 needs to be pushed down relative to inner receptacle 402 to overcome the biasing force of biasing element 408, and have the requisite manual strength and dexterity to rotate cover 302 relative to inner receptacle 402. To remove cover 302 and access the contents of inner receptacle 402, cover 302 must be pushed down relative to inner receptacle 402 to overcome the biasing force of biasing element 408 that is keeping cover 302 slightly raised, thus keeping protrusion 310 within recess 416. Once the biasing force of biasing element 408 has been overcome, protrusion 310 of cover 302 may be pushed down and may no longer be disposed within recess 416 of locking mechanism 412. This allows cover 302 to be rotated relative to inner receptacle 402 so that protrusion 310 can be moved away from locking mechanism 412 via rotation of cover 302. Once cover 302 has been rotated and protrusion 310 no longer engages with locking mechanism 412 of inner receptacle 402, cover 302 can be decoupled from inner receptacle 402 to access the contents within inner receptacle 402. Therefore, a child will not be able to access the contents stored within inner receptacle 402 as a child would not be able to easily remove cover 302 from inner receptacle 402, thereby preventing inadvertent access and use of items within restricted access container 300.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "proximal", "distal", "upper" and "lower" designate directions in the drawings to which reference is made. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

What is claimed is:

1. A restricted access container, comprising:

an outer shell defining a recess, the outer shell including:

a first wall including a first notch and a second notch defined thereby, the first notch and the second notch each having a closed end pointing toward each other relative to the first wall and an open end pointing away from each other relative to the first wall;

a second wall opposite the first wall;

a third wall extending between the first wall and the second wall; and an opening opposite the third wall, the opening defined by the first wall, the second wall, a fourth wall extending from the first wall to the second wall and a fifth wall extending from the first wall to the second wall; and an inner tray defining a receiving area, the inner tray including:

a tab extending from the inner tray and moveable relative thereto;

a first protrusion disposed on the tab; and a second protrusion disposed on the inner tray, wherein the inner tray is inserted through the opening into the recess of the outer shell such that the second protrusion is disposed within the second notch and the first protrusion is disposed within the first notch of the first wall to fix the inner tray relative to the outer shell in a locked position, wherein the first protrusion is pushed into the recess of the outer shell in an unlocked position, and wherein pulling the second protrusion away from second notch in the unlocked position slides the inner tray out of the outer shell.

2. The restricted access container of claim 1, wherein the first protrusion engages the first notch such that the inner tray is retained within the outer shell.

3. The restricted access container of claim 2, wherein the tab flexes toward the second wall when a force is applied to the tab, and wherein the first protrusion disengages from the first notch hole and the inner tray can be removed from the outer shell when the tab flexes toward the second wall.

4. The restricted access container of claim 2, wherein the first protrusion includes a first protrusion outer surface, the second protrusion includes a second protrusion outer surface, and the first wall includes a first wall outer surface, wherein the first protrusion outer surface and the second protrusion outer surface are flush with the first wall outer surface when the inner tray is within the outer shell.

5. The restricted access container of claim 1, wherein the second notch is disposed proximate to the opening.

6. The restricted access container of claim 1, wherein the inner tray further includes a tray top wall, a tray bottom wall, and a tray side wall.

7. The restricted access container of claim 6, wherein the tab is disposed on the tray side wall proximate to the tray bottom wall.

8. The restricted access container of claim 6, wherein a distance from the tray top wall to the tray bottom wall is less than a distance from the tray top wall to an end of the tab.

9. The restricted access container of claim 6, wherein the tab is a cantilevered extension of the tray side wall.

10. The restricted access container of claim 1, wherein the first protrusion and the second protrusion have the same shape.

11. The restricted access container of claim 1, wherein the second wall includes a third notch and a fourth notch defined thereby, the third notch and the fourth notch each having a closed end pointing toward each other relative to the second wall and an open end pointing away from each other relative to the second wall, wherein the inner tray includes a second tab extending from the inner tray and moveable relative thereto, a third protrusion disposed on the second tab, and a fourth protrusion disposed on the inner tray, and wherein the third protrusion is disposed within the third notch and the fourth protrusion is disposed within the fourth notch when the inner tray is in the locked position.

12. The restricted access container of claim 11, wherein the first protrusion, second protrusion, third protrusion, and fourth protrusion have the same shape.

13. The restricted access container of claim 6, wherein the inner tray further includes a flange extending from the tray bottom wall to the tray side wall and wherein the tab is spaced apart from the flange.

14. The restricted access container of claim 13, wherein the tab flexes toward the flange when a force is applied to the tab.

15. The restricted access container of claim 6, wherein the second protrusion is disposed on the tray side wall proximate the tray top wall.

16. The restricted access container of claim 1, wherein the second protrusion is fixed relative to the inner tray.

17. The restricted access container of claim 11, wherein the inner tray is moved from the locked position to the unlocked position by squeezing the tab toward the second tab.

18. The restricted access container of claim 17, wherein the inner tray slides out of the outer shell in a direction generally perpendicular to the direction of movement of the tab and the second tab.

19. The restricted access container of claim 1, wherein the first protrusion and the second protrusion include a plurality of ridges defined thereon.

20. The restricted access container of claim 1, wherein the tab is at least partially tapered.

21. The restricted access container of claim 20, wherein the taper of the tab is substantially similar to a shape of a corner of the outer shell.

22. The restricted access container of claim 1, wherein each of the closed ends is curved.

23. A restricted access container, comprising:

an outer shell defining a recess, the outer shell including:

a first wall including a first notch and a second notch defined thereby, the first notch and the second notch each having a closed end pointing toward each other relative to the first wall and an open end pointing away from each other relative to the first wall;

a second wall opposite the first wall including a third notch and a fourth notch defined thereby, the third notch and the fourth notch each having a closed end pointing toward each other relative to the second wall and an open end pointing away from each other relative to the second wall;

a third wall extending between the first wall and the second wall; and an opening opposite the third wall, the opening defined by the first wall, the second wall, a fourth wall extending from the first wall to the second wall and a fifth wall extending from the first wall to the second wall; and an inner tray defining a receiving area, the inner tray including:

a tray top wall;

a tray bottom wall;

a tray side wall;

a first tab extending from the inner tray and moveable relative thereto;

a second tab extending from the inner tray and moveable relative thereto;

a first protrusion disposed on the first tab;

a second protrusion disposed on the inner tray;

a third protrusion disposed on the second tab; and a fourth protrusion disposed on the inner tray, wherein the inner tray is inserted through the opening into the recess of the outer shell such that the first protrusion is disposed within the first notch and the second protrusion is disposed within the second notch of the first wall and the third protrusion is disposed within the third notch and the fourth protrusion is disposed within the fourth notch of the second wall to fix the inner tray relative to the outer shell in a locked position, wherein the first protrusion is pushed into the recess of the outer shell in an unlocked position, wherein pulling the second protrusion away from second notch in the unlocked position slides the inner tray out of the outer shell, wherein the first protrusion engages the first notch such that the inner tray is retained within the outer shell, and wherein the second notch is disposed proximate to the opening.

* * * * *